United States Patent [19]

Venot

[11] 4,136,512

[45] Jan. 30, 1979

[54] MACHINE FOR CONTINUOUS TWISTING AND CABLING

[76] Inventor: Jean Venot, La Mirandole, Villerest, 42300 Roanne, France

[21] Appl. No.: 814,431

[22] Filed: Jul. 11, 1977

[30] Foreign Application Priority Data

Jul. 12, 1976 [FR] France ..... 76 21370

[51] Int. Cl.[2] ..... D01H 1/10; D01H 9/18

[52] U.S. Cl. ..... 57/58.49; 57/268; 57/58.52; 57/64; 57/313

[58] Field of Search ..... 57/34 R, 53, 58.49, 57/58.52, 58.54, 58.55, 63–64

[56] References Cited

U.S. PATENT DOCUMENTS

| | | | |
|---|---|---|---|
| 1,935,242 | 11/1933 | Fulton | 57/58.49 X |
| 2,979,882 | 4/1961 | Bromley et al. | 57/58.54 X |
| 3,552,693 | 1/1971 | Scherf | 57/58.52 X |
| 3,599,413 | 8/1971 | Minitz et al. | 57/53 |
| 3,729,915 | 5/1973 | Mayer et al. | 57/53 |
| 3,846,965 | 11/1974 | Matsumura et al. | 57/58.52 |
| 4,023,339 | 5/1977 | Laderach et al. | 57/53 |

*Primary Examiner*—Charles Gorenstein

[57] ABSTRACT

A continuous twisting and cabling machine including a yarn feeding and twisting section and a cabling and rewinding section positioned below the twisting section. The twisting section includes a series of removable assemblies supporting a series of twist spindles, control and brake means for the spindles, connecting means to a transporter and fixing means for attachment to the cabling and rewinding section.

3 Claims, 4 Drawing Figures

MACHINE FOR CONTINUOUS TWISTING AND CABLING

The present invention relates to an improved machine for continuous twisting and cabling.

In the remainder of the description, one will designate by the expression "twister-cabler" the machine according to the invention.

It will be recalled that cables are those articles obtained by assembling by twisting (cabling) at least two previously twisted yarns during a twisting operation. These articles have a number of applications and are utilised, for example, for the construction of tyres, straps, continuous transport belts etc.

In practice, two techniques are used to form these cables.

The first, consists in forming the cable in two steps effected on separate machines, the yarns intended to form the cables being firstly twisted, for example on a twister or a mill, and thereafter being assembled in a cabling operation also on a twister or mill. The twist of the cable can either be of the same sense or of the opposite sense to the initial twist of the yarns which constitute the cable.

This technique gives rise to a number of difficulties, the principle ones being:

the risk of faults, due to the fact, on the one hand, of diverse operations to which the yarn windings are subjected during the different steps and, on the other hand, the variations of tension which are produced during the operation of cabling, many manual handling steps due to the various operations which are necessary in such a method, the large floor space occupied resulting from the use of two separate machines coupled with the fact that one must provide storage zones between the operations.

In order to reduce these disadvantages, it has been proposed to carry out the continuous operation of twisting and cabling on a single mill comprising:

a zone, called the twisting zone, in which one gives to the yarns the twist, for example with the aid of a simple or double twist spindle, and a zone, called the cabling zone, in which one assembles several previously twisted yarns during a twisting operation, this assembly being produced for example by means of double twist spindles or simple twist spindles having rings and flyers.

If the aforesaid plant enables one to avoid the manual operations and storage of the yarns with respect to the separate two stage methods, it gives rise however, to a certain number of disadvantages of which the main one is that of the height of the plant. This height which can reach three meters and even more, gives rise to difficulties in filling the feed supports. In fact, the feed supports are located beyond the reach of the operator, which necessitates the use of a ladder, or of a footway, or even the use of an elevator carriage.

Certain twister cablers are however rather compact, but then these necessitate the use of feed supports of small capacity, for example of cops, this requiring frequent operations to replace these supports.

The problem of feeding a plant is well known in the textile industry and it is increasing due to the increase in the weights of the supports of the yarn which often exceed 10 kilogrammes.

Thus, it has been proposed, notably in French Pat. application No. 2,248,346, to feed these texturising machines by means of supplies constituted by carriages which are provided above the mill.

It has equally been proposed, to feed the twisters by means of removable zones, which have been previously filled, and which are fed on the machine by means of transporter rails.

However, such arrangements are not suitable for assembler twisters, notably on those which comprise a double twist spindle for the twisting and a simple twist spindle having a ring and flyer for the assembly. In fact in such twister cablers, the feed bobbins are disposed in the double twist spindle itself. There is therefore an incompatibility, the feed bobbin not being able to be on the zone of the type indicated above, and in the double twist spindle.

According to the present invention there is provided a continuous twisting and cabling machine comprising a yarn feeding and twisting section, a cabling and rewinding section, positioned below the twisting section, the twisting section including a series of removable assemblies supporting:

(i) a series of twist spindles,
(ii) control and brake means for said spindles,
(iii) connecting means to a transporter,
(iv) fixing means for attachement to the cabling and rewinding section.

Such a construction permits the use as feed supports of feed bobbins having a large weight, exceeding 10 kilogrammes, and this by avoiding the manipulations of the material and in limiting to a minimum the floor area occupied by the plant. Moreover, the machine according to the invention permits the reduction to a minimum of the stopping of the machine when the feed supports are empty, which facilitates the work of the personnel before effecting the operation.

Advantageously, the yarn feeding and twisting section comprises double twist spindles, and the cabling and rewinding section comprises simple twist spindles having rings and flyers.

According to one embodiment of the invention, the removable modules for twisting are fixed directly, by any appropriate connecting means, but temporarily on to the frame carrying the cabling means. If desired, the twisting modules can be mounted in the upper part of the machine on an independent carrier structure.

The use of removable modules permits the fitting of the full bobbins to the feeder at the independent work stations. This facilitates the operation of the passage of the yarn into the various twisting members and permits feeding to the cabling unit of the modules in which all the operations of filling and of passage of the yarn to the twisting stage are effected. In this manner, the stop time of the machine can be reduced to a minimum.

It is clear that the drive motor mounted on each module is connectable to an appropriate electric power network.

Moreover, the braking means permit the stopping of the spindles in determined positions.

In one preferred embodiment of the invention, the removable twisting modules are constituted by a frame supporting two series of double twist spindles, positioned horizontally on each side of control means, the said control means being driven by a motor fixed on the upper part of the frame, connectable to the electrical mains, and associated with braking means.

Advantageously, the braking means are constituted by a pneumatic jack which act on two shoes which are applied on the drive shaft of the motor.

The frame comprises equally positioning and fixation means on the cabling section as well as connecting means with the transporter device.

Preferably, during the putting in place of the movable twisting modules, these means are previously positioned such that the latter, when they are in the normal work position, do not rest on the transport device.

As indicated above, the double twist spindles of the twisting means are preferably disposed horizontally on each side of a frame support, the driving of the two series of spindles being themselves by belts driven by a single motor. The frame support comprises essentially two vertical spindle carrier plates, spaced from one another, and joined by cross pieces, the whorls of the spindles opening into the space formed between the plates. This horizontal disposition of the double twist spindles gives rise to numerous advantages, among which one should mention a large increase in space and the possibility of having an unlimited number of ranges of feed supports, which permits the easy use of various types of cables of two, three or more constituents. The spindle utilised not only as the double twist spindles of the twisting section, but also the simple twist spindles having rings and flyers of the cabling part may be of the conventional type. One may use for the double twist spindles, the horizontal spindles of a hollow spindle type mounted on rollers, and for the simple twist spindles, spindles of the H2 type sold by the SKF Company.

The invention will be better understood from the following description, given merely by way of example, reference being made to the accompanying drawings, in which.

Figure 1:
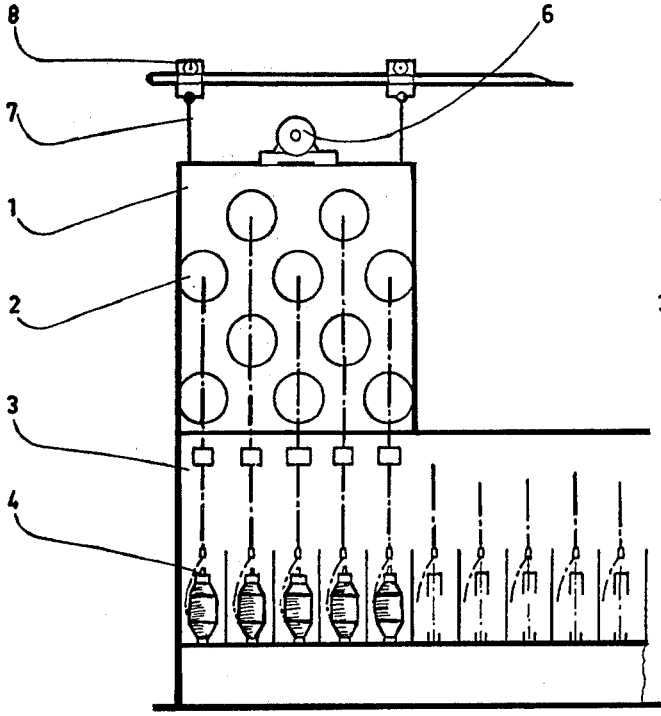
FIGS. 1 and 2 show schematically, in a front and side view, one embodiment of twister-cabler machine according to the invention.
Figure 2:
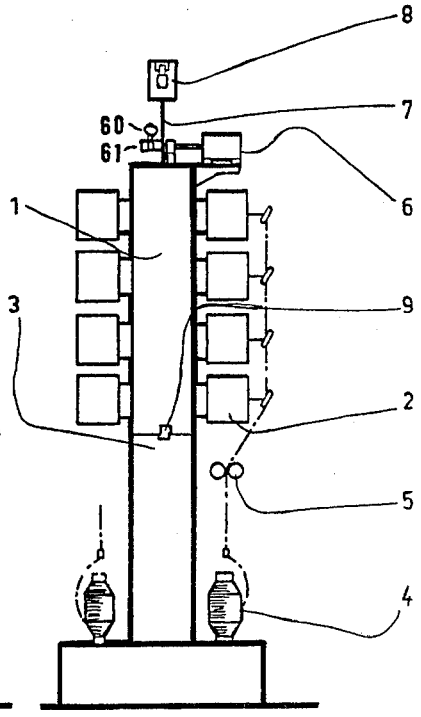

Thus FIGS. 1 and 2 show a twister cabler according to the invention comprising a yarn feed and twisting section 1, including double twisting spindles 2, and a cabling and rewinding section 3 including a simple twist spindle 4 having a ring and flyer, the said section 3 being positioned below the section 1 of twisting and the yarn coming from the section 1 being fed by means of feeders 5.

According to the invention, the feed and twisting section 1 is provided in the form of a removable module comprising:

double twist spindles 2, feed means 6, and brakes 60/61 of spindles 2, connecting means to a transporter 8, fixing means 9 of a twisting module 1 on a support. In the present case, the fixing means are fixed to the cabling section 3.

Figure 3:
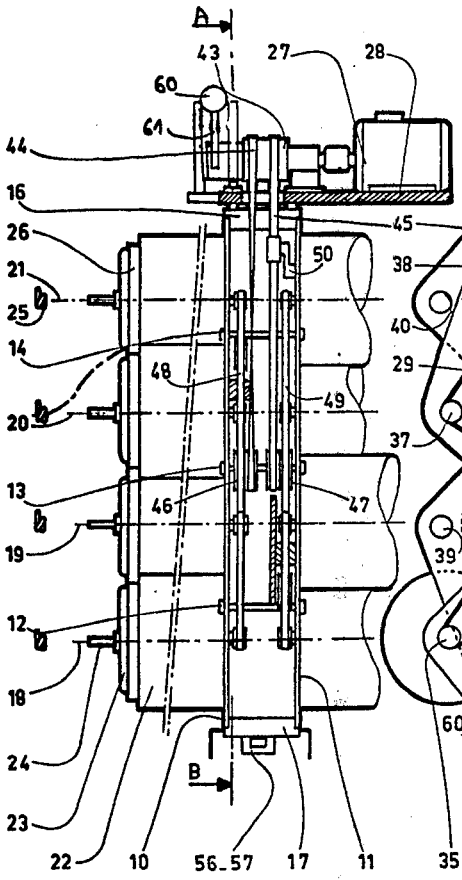
FIGS. 3 and 4 are detailed views which show respctively in side view and in front view, substantially in section along the line AB of FIG. 3, the assembly of a removable twisting module according to the invention.
Figure 4:
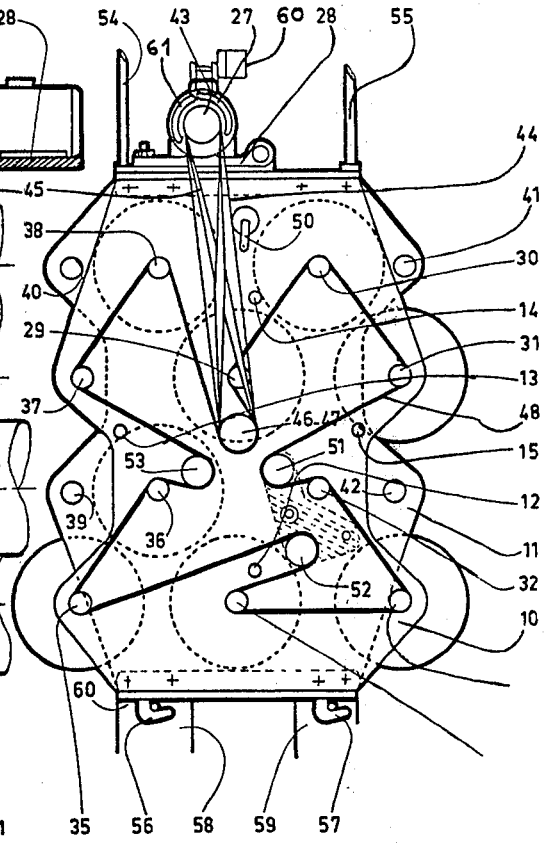

The conception and function of the removable feed and twisting modules are illustrated in a more detailed manner by FIGS. 3 and 4.

As one can see on these Figures, the removable feed and twisting module comprises essentially, a frame constituted by two vertical rigid plates 10 and 11 maintained separate, on the one hand by cross members 12, 13, 14, 15 and on the other hand by two transverse support elements 16 and 17 connecting the two ends of the plates 10 and 11, or any other connecting piece ensuring a good rigidity of the assembly.

This frame supports two series of double twist spindles. According to the invention, these double twist spindles are mounted horizontally, one series being maintained on the support plate 10 and the other series on the support plate 11.

In the present case, each series comprises ten spindles, disposed at four levels 18, 19, 20 and 21, the spindles being offset between two successive levels, these levels 18 to 20 comprising three spindles, the levels 19 and 21, two spindles.

These spindles are of the classical double twist spindle type, and on FIG. 3, there is shown schematically a bowl 22, a crown 23, the spindle 24, a pigtail 25 and a balloon limiter 26 of the spindle. Preferably, the pigtails 25 are mounted on retractable supports (not shown) which permits the clearing of the space necessary to put in place the full bobbin, as well as the raising of the empty bobbin support.

The fixing means on the cabling section are constituted in a simple manner, by hooks 56 and 57, fixed to the lower part 17 of the module, the said hooks 56 and 57 being able to be fixed with positioning and locking elements 58 and 59. The drive and braking of the two series of spindles is obtained according to the invention by means of a single motor 27 associated with a braking device comprising a pneumatic jack 60 and shoes 61 mounted on the transverse upper element 16, by means of a support 28. Due to this arrangement, it is possible to drive and brake the two series of double twist spindles with the aid of a single motor and of a single brake due to the fact that the drive whorls 29, 30, 31, 32, 33, 34, 35, 36, 37 and 38 of the first series of spindles and those 39, 40, 41, 42 of the second series of spindles are placed in facing relation in the space defined between the two vertical plates 10 and 11. In the present case, for the sake of simplicity, there have only been shown four of the ten whorls of the plate 11, the ten whorls of the spindles mounted on the plate 10 being shown, as well as the belt 48, the belt 49 and its tensioning device not being shown in FIG. 4. Moreover, if one considers FIG. 4 which is a section along the line AB of FIG. 3, there is shown the outlines of plate 10, although normally, this outline would not appear. Equally there is shown in phantom the position of the spindles mounted on the plate 10.

As is said above, the motor 27 drives through the intermediary of the pulley 43, the two series of spindles connected to the two belts 44-45 which each act on the whorl of a series of spindles through the intermediary of pulleys 46 and 47 which drive the belt 48-49 in direct contact with the drive whorls of the spindles. The tension of the belts, as well as its path, is regulated by any appropriate means, such as an idler pulley and tensioners 50, 51, 52, 53.

Moreover on the same pulley 43 as that of the motor, a brake, constituted by shoes 61 and a jack 60 acting on the said shoes, permits the stopping of the rotatable members in particular of the spindles at a chosen time by the operator and controlled by the latter.

According to the invention, the removable twisting modules are connected:

on the one hand by connecting means to a transporter device permitting the movement of the said means on an independent operating area, on the other hand by fixing means to the cabling section.

In the present embodiment:

the treating modules comprise suspension rods 54, 55, fixed on the upper part 16 of the modules, the said rods permitting the connection to a classical transport device, not shown in FIGS. 3 and 4, for example a transporter device of the type "Tourtellier", fixing means on the cabling section are constituted, in a simple manner, by hooks 56-57 fixed to the lower part 17 of the module, said hooks 56-57 being fixed with the positioning and hooking elements 58-59 fixed on the upper part of the frame 60 of the cabling zone. In normal operation, one relieves the transporter device of the weight of the twisting modules while it is travelling due to a device (not shown) and forming part of the cabling machine.

The advantages arising from the twister cabler according to the invention will be seen more clearly from the operations of control which are necessary for use.

These operations can be summarised as follows, with respect to the general FIGS. 1 and 2.

At the end of the cycle, when the feed windings 2 are practically exhausted, one cuts the yarns at the entry of the feeders 5.

The modules 1 are unbolted from their supporters, in the present case from the cabling frame 3, and the electric feed of the motor is switched off.

The modules 1 are then moved by the conveyor 8 to an operating area and, at the same time, the modules provided with full bobbins are fed onto the machine.

On the modules to be refilled, one effects the appropriate procedure: at the disappearance of the yarns of the exhausted feed windings, at the possible cleaning and refilling of the full windings, the yarns are passed in the double twist spindles 2 and fed up to the exterior parts of the modules where they can be temporarily crossed in a manner to be ready to be tied with the corresponding yarns of the cabling machine 3.

On the machine, the previously filled modules 1, are bolted and plugged in and a team proceeds to knot end to end each feed yarn with its corresponding yarn on the cabling machine 2.

It should be noted therefore that the twister-cabler according to the invention, permits, as has been previously said, limiting to the minimum the machine stop time, therefore, the loss of production during the operations of charging and uncharging of the feed bobbins.

Moreover, the apparatus provides equally the advantage of permitting the use of workmen at fixed positions, the storage of the feed windings being able to be made in a rational manner, which facilitates their task. Finally, the use of an elevator carriage is not necessary, which allows the limiting of the floor area of the installation.

It is clear that the invention is not limited to the embodiment described, but it equally covers all the variations which flow therefrom.

I claim:

1. A continuous twisting and cabling machine comprising a yarn feeding and twisting section, a cabling and rewinding section positioned below the twisting section, the twisting section including a series of removable assemblies, each removable assembly supporting:

(i) a series of twist spindles, (ii) control means driven by a motor fixed on said feeding and twisting section and associated with brake means for said spindles, (iii) connecting means for connecting the assembly to a transporter, and (iv) fixing means for attachment to the cabling and rewinding section.

2. A continuous twisting and cabling machine according to claim 1 wherein the spindles of the feed and twisting section are double twist spindles, said cabling and rewinding section comprising simple twist spindles having rings and flyers.

3. A continuous twisting and cabling machine according to claim 2 wherein each removable twisting assembly comprises a frame, two series of double twist spindles supported on said frame and positioned horizontally on each side of said frame, a single motor and belts to drive the two sets of spindles from said spindle motor.

* * * * *